US011162321B2

(12) United States Patent
Watson et al.

(10) Patent No.: US 11,162,321 B2
(45) Date of Patent: Nov. 2, 2021

(54) MULTI-ZONE WELL TREATMENT

(71) Applicant: THRU TUBING SOLUTIONS, INC., Oklahoma City, OK (US)

(72) Inventors: Brock W. Watson, Sadler, TX (US); Andrew M. Ferguson, Moore, OK (US); Roger L. Schultz, Newcastle, OK (US)

(73) Assignee: Thru Tubing Solutions, Inc., Newcastle, OK (US)

( * ) Notice: Subject to any disclaimer, the term of this patent is extended or adjusted under 35 U.S.C. 154(b) by 0 days.

(21) Appl. No.: 15/704,865

(22) Filed: Sep. 14, 2017

(65) Prior Publication Data

US 2018/0073321 A1 Mar. 15, 2018

Related U.S. Application Data

(60) Provisional application No. 62/394,259, filed on Sep. 14, 2016.

(51) Int. Cl.
*E21B 33/12* (2006.01)
*E21B 43/26* (2006.01)
(Continued)

(52) U.S. Cl.
CPC ..... *E21B 33/12* (2013.01); *E21B 33/124* (2013.01); *E21B 34/063* (2013.01); *E21B 43/14* (2013.01); *E21B 43/26* (2013.01)

(58) Field of Classification Search
CPC . E21B 43/14; E21B 43/16; E21B 7/04; E21B 43/26; E21B 33/12; E21B 33/124
See application file for complete search history.

(56) References Cited

U.S. PATENT DOCUMENTS 3,661,206 A * 5/1972 Putch ..... E21B 33/047 166/89.2
3,741,300 A * 6/1973 Wolff ..... E21B 43/02 166/184

(Continued)

OTHER PUBLICATIONS

International Search Report with Written Opinion dated Jan. 3, 2019 for PCT Patent Application No. PCT/US2018/050454, 18 pages.

(Continued)

*Primary Examiner* — Aaron L Lembo
(74) *Attorney, Agent, or Firm* — Smith IP Services, P.C.

(57) ABSTRACT

A method of treating each of multiple formation zones in a subterranean well can include isolating two of the zones from each other in the wellbore with a plug assembly positioned in the wellbore; treating one of the zones by flowing a treatment fluid through openings that provide fluid communication between the wellbore and one of the zones; then blocking flow through the openings; increasing pressure in the wellbore in response to the blocking; and opening the plug assembly in response to the pressure increasing. A well treatment system for treating each of multiple zones intersected by a wellbore can include multiple plug assemblies in the wellbore, each of the plug assemblies isolating a respective adjacent pair of the zones from each other in the wellbore. Each of the plug assemblies opens in response to a respective predetermined pressure differential applied across the plug assembly.

39 Claims, 7 Drawing Sheets

(51) Int. Cl.

| | |
|---|---|
| ***E21B 43/14*** | (2006.01) |
| ***E21B 34/06*** | (2006.01) |
| ***E21B 33/124*** | (2006.01) |

(56) References Cited

U.S. PATENT DOCUMENTS 4,476,945 A * 10/1984 Hearn ..... E21B 19/22 175/203
4,945,995 A * 8/1990 Tholance ..... E21B 34/102 166/321
5,048,611 A * 9/1991 Cochran ..... E21B 21/103 166/374
5,205,365 A * 4/1993 Quintana ..... E21B 4/18 166/380
5,311,954 A * 5/1994 Quintana ..... E21B 4/18 166/383
5,411,082 A * 5/1995 Kennedy ..... E21B 7/061 166/181
5,427,177 A * 6/1995 Jordan, Jr. ..... E21B 7/061 166/117.5
5,526,880 A * 6/1996 Jordan, Jr. ..... E21B 33/16 166/291
5,626,193 A * 5/1997 Nzekwu ..... E21B 43/2406 166/303
5,730,221 A * 3/1998 Longbottom ..... E21B 7/061 166/298
5,884,704 A * 3/1999 Longbottom ..... E21B 7/061 166/117.6
5,960,883 A * 10/1999 Tubel ..... E21B 34/066 166/313
5,988,278 A * 11/1999 Johnson ..... E21B 43/305 166/245
6,186,230 B1 * 2/2001 Nierode ..... E21B 43/006 166/250.1
6,230,803 B1 * 5/2001 Morton ..... E21B 43/045 166/278
6,662,870 B1 * 12/2003 Zupanick ..... E21B 7/046 166/245
6,729,394 B1 * 5/2004 Hassan ..... E21B 43/17 166/245
6,907,930 B2 * 6/2005 Cavender ..... E21B 41/0042 166/242.3
6,986,388 B2 * 1/2006 Zupanick ..... E21B 7/046 166/245
7,059,402 B2 * 6/2006 Lima ..... E21B 43/305 166/245
7,059,415 B2 * 6/2006 Bosma ..... E21B 33/1208 166/179
7,104,320 B2 * 9/2006 Buchanan ..... E21B 43/006 166/245
7,377,322 B2 * 5/2008 Hofman ..... E21B 21/103 166/120
7,431,091 B2 * 10/2008 Themig ..... E21B 34/14 166/317
7,464,756 B2 * 12/2008 Gates ..... C09K 8/592 166/263
7,513,204 B2 * 4/2009 Hickok ..... B63B 3/44 114/121
8,127,845 B2 * 3/2012 Assal ..... E21B 43/14 166/157
8,220,547 B2 * 7/2012 Craig ..... E21B 43/26 166/177.5
8,459,365 B1 * 6/2013 Schultz ..... E21B 34/14 166/332.4
8,528,639 B2 * 9/2013 Fang ..... E21B 43/2406 166/272.1
8,646,526 B2 * 2/2014 Suarez-Rivera ..... E21B 43/305 166/250.1
8,651,177 B2 * 2/2014 Vail, III ..... E21B 28/00 166/119
8,978,773 B2 * 3/2015 Tilley ..... E21B 43/14 166/351
9,062,543 B1 * 6/2015 Snider ..... E21B 23/06
9,249,652 B2 * 2/2016 Montgomery ..... E21B 33/127
9,303,501 B2 * 4/2016 Fehr ..... E21B 33/124
9,366,123 B2 * 6/2016 Fehr ..... E21B 33/124
10,184,316 B2 * 1/2019 Flores Perez ..... E21B 34/14
10,358,892 B2 * 7/2019 Wakefield ..... E21B 34/063
2003/0139298 A1 * 7/2003 Fu ..... C09K 8/68 507/200
2004/0261990 A1 * 12/2004 Bosma ..... E21B 33/1208 166/50
2005/0082061 A1 * 4/2005 Nguyen ..... E21B 43/045 166/278
2007/0158073 A1 * 7/2007 Green ..... E21B 41/0035 166/313
2008/0164026 A1 * 7/2008 Johnson ..... E21B 33/124 166/271
2009/0159279 A1 * 6/2009 Assal ..... E21B 43/045 166/278
2009/0260814 A1 * 10/2009 Malone ..... E21B 43/02 166/276
2011/0024121 A1 * 2/2011 Skeates ..... E21B 41/0035 166/308.1
2013/0133897 A1 * 5/2013 Baihly ..... C22C 21/10 166/376
2013/0139298 A1 6/2013 Crump et al.
2013/0228337 A1 * 9/2013 Dombrowski ..... E21B 43/17 166/308.1
2013/0327572 A1 * 12/2013 Sponchia ..... E21B 41/0035 175/61
2014/0034308 A1 2/2014 Holderman et al.
2014/0246209 A1 9/2014 Themig et al.
2015/0007988 A1 * 1/2015 Ayasse ..... E21B 43/17 166/271
2015/0007996 A1 * 1/2015 Ayasse ..... E21B 43/17 166/308.1
2015/0021021 A1 * 1/2015 Merron ..... E21B 43/26 166/255.1
2015/0107829 A1 * 4/2015 Themig ..... E21B 47/135 166/255.1
2015/0167424 A1 * 6/2015 Richards ..... E21B 33/134 166/386
2015/0233226 A1 * 8/2015 Holzhauser ..... E21B 43/267 166/280.1
2015/0369003 A1 * 12/2015 Hajjari ..... E21B 29/002 166/298
2016/0047194 A1 * 2/2016 Snider ..... E21B 33/12 166/297
2016/0069182 A1 * 3/2016 Neale ..... E21B 47/16 166/254.2
2016/0215581 A1 * 7/2016 Ingraham ..... E21B 43/26
2016/0215605 A1 * 7/2016 Fontenot ..... E21B 43/14
2016/0333680 A1 * 11/2016 Richter ..... E21B 43/26
2016/0356137 A1 * 12/2016 Hardesty ..... E21B 34/063
2017/0051594 A1 * 2/2017 Dallas ..... E21B 43/16
2017/0218739 A1 * 8/2017 Dallas ..... E21B 43/16

OTHER PUBLICATIONS

Canadian Examination Report dated Dec. 11, 2020 for CA Patent Application No. 3,059,990, 3 pages.
GCC Examination Report dated Feb. 11, 2021 for GCC Patent Application No. 2018-35986, 5 pages.

* cited by examiner

MULTI-ZONE WELL TREATMENT

BACKGROUND

This disclosure relates generally to equipment utilized and operations performed in conjunction with a subterranean well and, in an example described below, more particularly provides for convenient treatment of multiple zones in a well.

Well treatments (such as, various types of stimulation operations, conformance operations, etc.) typically involve flowing treatment fluids, gels, slurries, spacers, etc., from surface through a wellbore to open perforations or other openings providing communication between the wellbore and at least one formation zone penetrated by the wellbore. In situations where multiple zones are to be treated, it can be difficult to maintain sufficient flow velocity in the wellbore to prevent settling out of proppant (such as sand or synthetic particulates) from the treatment fluid, or to achieve a sufficient pressure increase to properly fracture or otherwise treat each of the zones.

Therefore, it will be appreciated that improvements are continually needed in the art of constructing and utilizing multiple zone well treatments. Such improvements may be useful in a wide variety of different types of well treatments.

DETAILED DESCRIPTION

Figure 1:
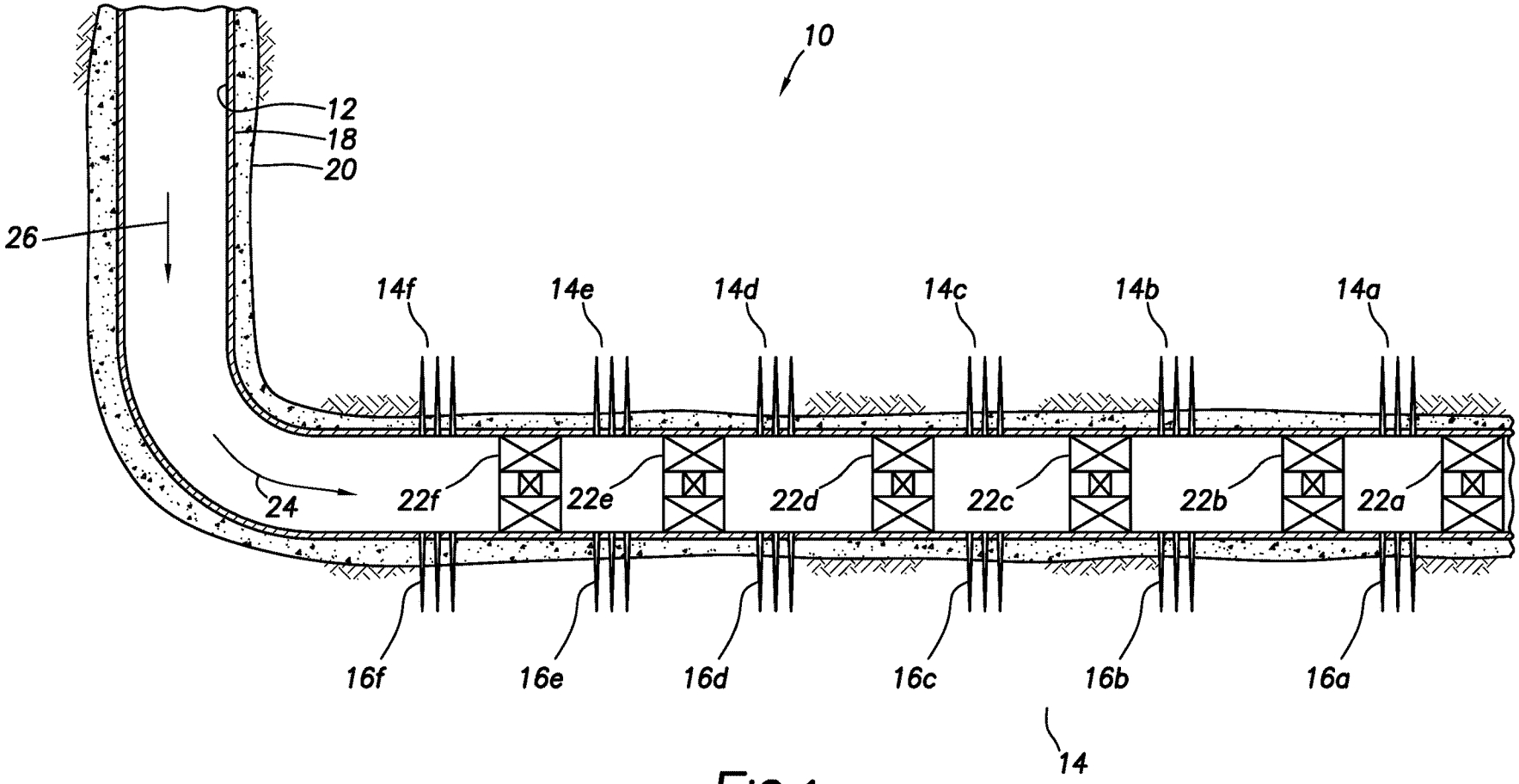
FIG. 1 is a representative partially cross-sectional view of an example of a well treatment system and associated method which can embody principles of this disclosure.

Representatively illustrated in the accompanying drawings and described below is a plug assembly, and a multi-zone well treatment system and method, which can embody the principles of this disclosure. However, it should be clearly understood that the plug assembly, system and method are merely one example of an application of the principles of this disclosure in practice, and a wide variety of other examples are possible. Therefore, the scope of this disclosure is not limited at all to the details of the plug assembly, system and method described herein and/or depicted in the drawings.

The plug assembly's use is described below in conjunction with a well re-fracturing operation. However, the plug assembly is not limited to only this use, and the plug assembly may be used in other systems and methods, within the scope of this disclosure.

In examples described below, an apparatus and a method are provided for re-fracturing a well in segments using a special drillable plug or packer assembly. This plug assembly allows a well to be fractured in two or more segments instead of in one large fracturing operation. Smaller fracturing lengths increase average fluid velocity per open perforation and reduce a tendency to sand off at a lower end.

Long horizontal wells are commonly fractured in stages starting at a bottom or distal end of a wellbore. Each stage is separated by a plug or a baffle to isolate zones above and below the plug from each other.

These wells eventually need to be re-fractured to improve or restore reduced production. A re-fracture may be used to correct a mistake in the original fracturing operation, open up portions of a formation that were not fractured on the original treatment, or re-fracture through the original perforations to break up accumulated debris and deposits that may be restricting flow.

A well can be re-fractured by pumping treatment fluid (usually a slurry comprising water and sand or other proppant) from surface down through casing lining the wellbore, and into perforations that most readily accept the treatment fluid. Usually, most of the fluid goes into perforations closest to a heel of the wellbore (a transition between substantially vertical and substantially horizontal portions of the wellbore). The heel takes fluid more easily than lower zones because pipe friction is lowest at the heel. However, all open perforations in the well typically will be taking some fluid.

After a desired amount of treatment fluid has been pumped, a diverter typically is used to plug the perforations that are taking the most fluid, and thereby divert treatment fluid to other perforations to form additional fracturing in the formation. This diversion and fracture process continues until all zones have been treated.

There is a problem with re-fracturing, especially (although not exclusively) in long horizontal wellbores. In such situations, there may be many perforations, perhaps one thousand or more. A minimum flow rate is required to fracture new rock and to maintain proppant flow into a particular perforation. If too much treatment fluid bleeds away from the fracturing operation at the upper zones (for example, near the heel) and into the many open perforations below, the flow rate may be too low to fracture an upper zone.

Another problem is that the treatment fluid bleeding off into the lower zones will have a low velocity that keeps decreasing as it traverses more and more perforations that each accepts some of the fluid. Eventually, the velocity will become so low that it allows sand or other proppant to drop out of the flow and form a dune. This dune blocks off lower zones and prevents them from being treated.

Solutions to these problems are provided by the present disclosure. However, it should be clearly understood that the scope of this disclosure is not limited to solving any particular problem in multi-zone well treatment, or to use of the principles of this disclosure for any particular purpose.

Referring additionally now to FIG. 1, an example of a well treatment system 10, and an associated method, that may be used with a subterranean well is representatively illustrated. The well treatment system 10 and method are merely one example of an application of the principles of this disclosure, other well treatment systems and methods can incorporate the principles of this disclosure, and so the scope of this disclosure is not limited to any of the details of the system 10 and method as described herein or depicted in the drawings.

In the FIG. 1 example, a wellbore 12 penetrates an earth formation 14. Openings 16*a-f* (such as, perforations) are formed through casing 18 and cement 20 lining the wellbore 12, thereby providing fluid communication between an interior of the casing and each of multiple formation zones 14*a-f*. The zones 14*a-f* may be zones or sections of a single earth formation 14, or they may be zones of multiple formations.

Note that it is not necessary to form perforations through the casing 18 and cement 20 to provide fluid communication between the wellbore 12 and the formation zones 14*a-f*. In other examples, the openings 16*a-f* could be provided in pre-perforated or slotted liner, in casing valves, or in another structure.

As used herein, the term "casing" is used to refer to a generally tubular wellbore lining. Casing may be made up of tubulars known to those skilled in the art as casing, tubing, liner or pipe. Casing may be continuous or segmented. Casing may be made of metal, composites, plastics or other materials. Casing may be pre-fabricated or formed in situ.

As used herein, the term "cement" is used to refer to a flowable and hardenable substance that, when hardened, seals off an annulus formed between casing and a formation wall (or another outer tubular). Cement does not necessarily comprise a cementitious material, since polymers, composites, and other types of materials may be used for sealing off the annulus. The cement 20 in the FIG. 1 example could be replaced, in whole or in part, by devices such as external casing packers (ECP's) positioned between adjacent ones of the zones 14*a-f*.

As depicted in FIG. 1, the wellbore 12 is substantially horizontal in a section thereof intersecting the zones 14*a-f*. In other examples, the wellbore 12 could be substantially vertical, or otherwise deviated relative to vertical, in keeping with the scope of this disclosure.

As used herein, the terms "above," "below," "upper," "lower," and similar terms, are used to refer to locations along the wellbore 12 with respect to their relative distance from the surface along the wellbore. Thus, a location referred to as being "upper" or "above" another location is nearer the surface along the wellbore than the other location, and a location referred to as being "lower" or "below" another location is farther from the surface than the other location, in the FIG. 1 example. However, the scope of this disclosure is not limited to any particular relative locations of devices or steps in the system 10 and method.

In the FIG. 1 example, the wellbore 12 is divided into two or more sections separated by one or more plug assemblies 22*a-f*. These plug assemblies 22*a-f* in various examples may have an expandable ball seat, a shear pinned piston, a rupture disk, or a similar device, that allows fluid to pass through it at a pre-determined set pressure.

Note that it is not necessary for a single one of each of the plug assemblies 22*a-f*, the zones 14*a-f* and the sets of openings 16*a-f* to correspond to each other. In other examples, multiple sets of openings could be associated with a single zone, multiple zones could be located between an adjacent pair of plug assemblies, multiple plug assemblies could be associated with a single zone, etc. Thus, the scope of this disclosure is not limited to any particular configuration, arrangement, correspondence or association between particular numbers of the plug assemblies 22*a-f*, the zones 14*a-f* and the openings 16*a-f*.

In the FIG. 1 method, the "upper" zone 14*f* is treated first by flowing a treatment fluid 24 from the surface, through the wellbore 12 and outward into the zone 14*f* via the openings 16*f*. Since the exposed upper zone 14f is substantially shorter than the combined zones 14*a-f*, the treatment process is improved because the number of openings 16*f* is within limitations of treatment equipment and casing flow capacity.

After the upper zone 14f is completely treated, a diverter 26 is used to block flow through the openings 16*f* and prevent flow from the wellbore 12 and into the upper zone. Various different types of diverting agents may be used for the diverter 26. For example, discrete plugging devices (such as, the plugging devices described in U.S. Pat. No. 9,567,826), particulate diverting agents (such as, calcium carbonate, poly-lactic acid or poly-glycolic acid) or suitable gels may be used. The scope of this disclosure is not limited to use of any particular diverter to block flow through the openings 16*f*.

After all of the openings 16*f* are blocked, and as the treatment fluid 24 continues to be pumped from surface, pressure in the wellbore 12 above the plug assembly 22*f* will increase. When the pressure increases to a predetermined opening pressure of the plug assembly 22*f*, a central flow passage of the plug assembly will open, thereby permitting the treatment fluid 24 to flow through the plug assembly 22*f* and into the wellbore 12 adjacent the next zone 14*e*.

The plug assembly 22*f* opening pressure would typically be set higher than the zone 14*f* break down pressure. For a fracturing or re-fracturing operation, the plug assembly 22*f* opening pressure may be greater than a fracture pressure of the zone 14*f*.

In one example described more fully below, a piston (or a shear pin securing the piston) shears, allowing the treatment fluid 24 to pass through the central flow passage of the plug assembly 22*f*. The zone 14*e* below the plug assembly 22*f* is then exposed to the treatment fluid 24 and pressure. As the treatment operation continues, no additional fracturing or other treatment occurs on the upper zone 14*f*, because it has been blocked off completely by the diverter 26.

The above-described process can be repeated for each of the zones 14*a-e* so that, at a conclusion of the treatment operation, all of the zones 14*a-f* have been treated. The central flow passages of each of the plug assemblies 22*a-f* are open (although the central passage of the plug assembly 22*a* may remain closed if communication with zones below the zone 14*a* is not desired or required).

Thus, each of the zones 14*a-f* can then be produced after removal, dispersal or degrading of the diverter 26 in each zone. For example, the diverter 26 could be dissolvable or otherwise degradable in response to contact with a particular fluid (such as, an acid), passage of a period of time, exposure to increased temperature, etc. In some examples, the diverter 26 can be flowed to surface with produced fluids.

The plug assemblies 22*a-f* can be removed after the treatment operation, if desired. For example, the plug assemblies 22*a-f* may be made of materials that are drillable or degradable downhole. In other examples, the plug assemblies 22*a-f* may be unset and retrieved from the well.

Figure 2:
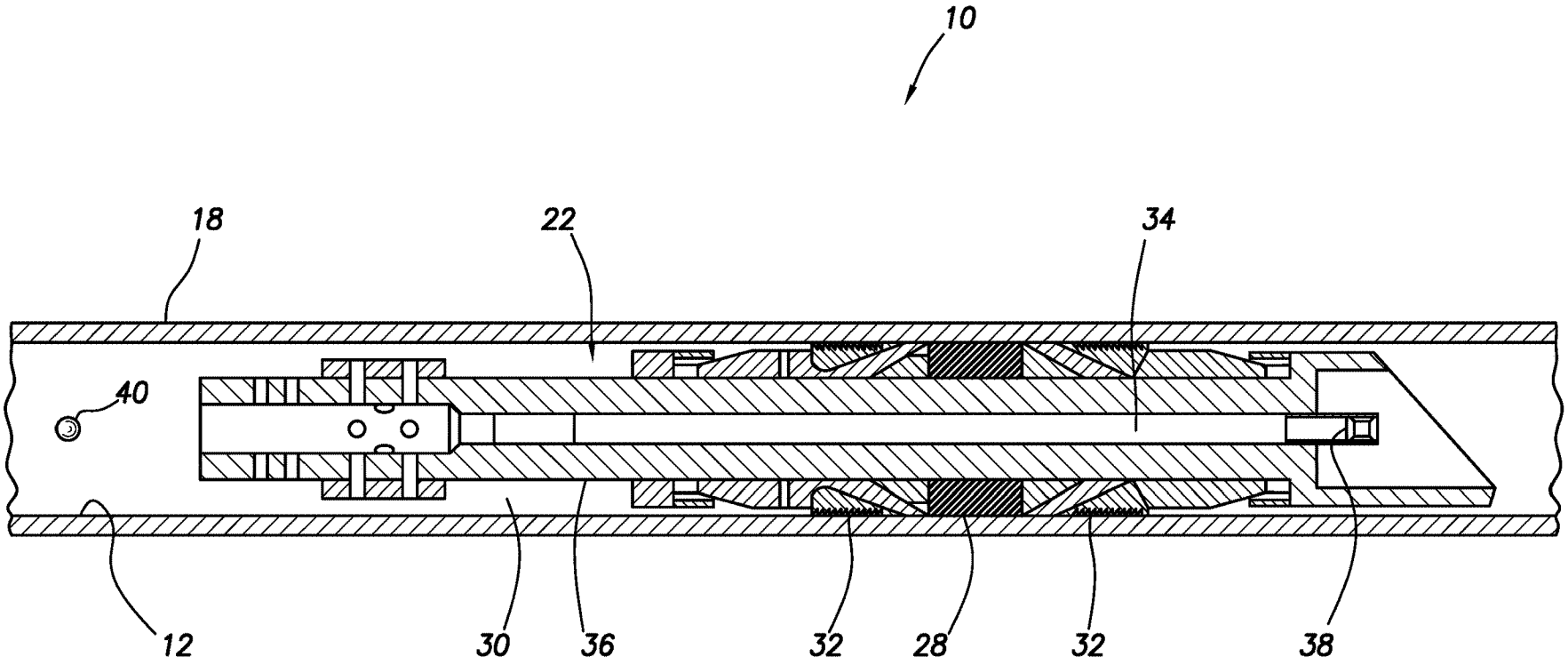
FIG. 2 is a representative cross-sectional view of an example of a plug assembly which may be used in the system and method of FIG. 1.
Figure 4:
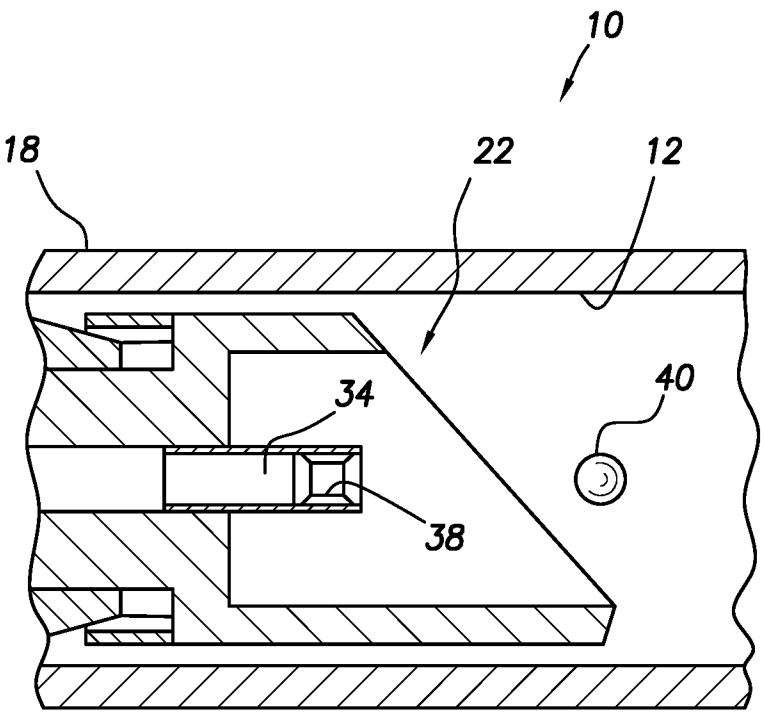
FIGS. 3 & 4 are representative cross-sectional views of a portion of the plug assembly in plugged and unplugged configurations.
Figure 3:
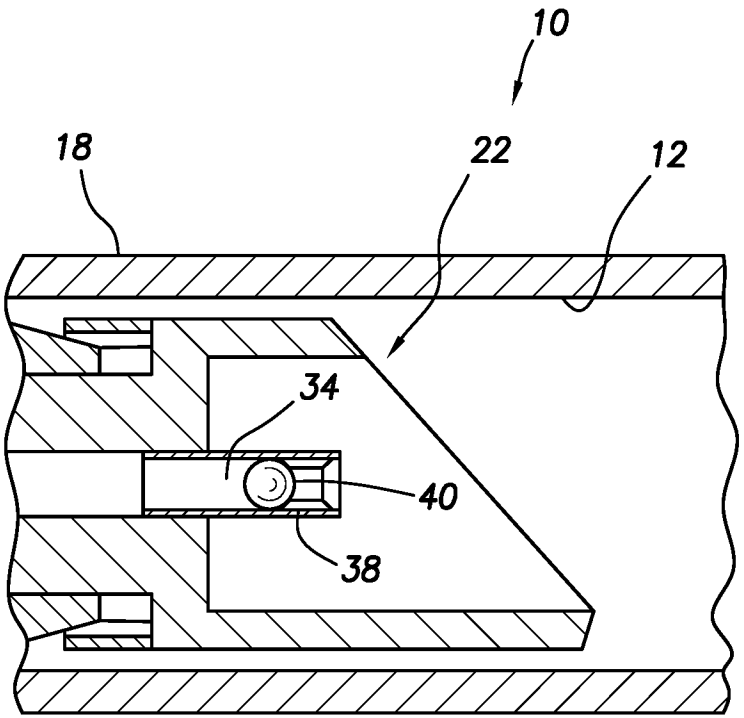

Referring additionally now to FIGS. 2-4, a cross-sectional view of an example of a plug assembly 22 as used in the well system 10 and method of FIG. 1 is representatively illustrated. The plug assembly 22 of FIGS. 2-4 may be used for any of the plug assemblies 22*a-f* in the well system 10, or it may be used in other well systems and methods.

The plug assembly 22 in this example is similar in many respects to a typical "frac" plug or fracturing plug, in that it includes at least one annular seal element 28 for sealingly engaging an inner surface of the wellbore 12 (such as, an inner surface of the casing 18 or other outer tubular), and sealing off an annulus 30 formed radially between the plug assembly 22 and the wellbore. The plug assembly 22 also includes one or more slips 32 for grippingly engaging the inner surface of the wellbore 12, and preventing longitudinal displacement of the plug assembly 22 relative to the wellbore.

In the plug assembly 22 example of FIGS. 2-4, a flow passage 34 extends longitudinally through a generally tubular inner mandrel 36. The flow passage 34 provides for fluid communication between the wellbore 12 on opposite sides of the plug assembly 22.

An internal annular seat 38 is provided with the flow passage 34, so that flow through the passage also flows through the seat. In the FIGS. 2-4 example, the seat 38 has an internal diameter that is smaller than an outer diameter of a plug 40 (such as, an operating ball or a sealing dart).

The plug 40 may be installed in the plug assembly 22 before or after the plug assembly is set in the wellbore 12, in order to prevent flow through the flow passage 34. Note that, in this example, flow is prevented in one direction (downhole or to the right as viewed in FIGS. 2-4), but is permitted in an opposite direction (uphole or to the left as viewed in FIGS. 2-4), when the plug 40 is installed. If the plug 40 is to be installed after the plug assembly 22 is set, it may be carried by flow and/or gravity into sealing engagement with the seat 38.

When the plug 40 is sealingly engaged with the seat 38, a predetermined pressure differential applied across the plug and seat will cause the plug to be discharged into the wellbore 12 below the plug assembly 22, thereby permitting downward flow through the flow passage 34. For example, the seat 38 could be expandable so that its inner diameter increases and the plug 40 is permitted to pass through the seat when the predetermined pressure differential is applied. In another example, the plug 40 could be retractable, so that it retracts or compresses inward and is permitted to pass through the seat 38 when the predetermined pressure differential is applied. In yet another example, a portion of the seat 38 or the plug 40 could shear or otherwise release, thereby permitting flow in both directions through the passage 34, in response to the predetermined pressure differential being applied across the plug and/or seat.

In FIG. 2, the plug assembly 22 is depicted as being set in the wellbore 12. The seal element 32 sealingly engages the inner surface of the casing 18, and the slips 32 grippingly engage the inner surface of the casing. The plug 40 is not yet installed in the flow passage 34, in this example, but is being conveyed toward the plug assembly 22 by flow through the casing 18.

In FIG. 3, the plug 40 is sealingly engaged with the seat 38. Flow through the passage 34 is now prevented from an upper to a lower side of the plug assembly 22.

In FIG. 4, the predetermined pressure differential has been applied across the plug 40 and seat 38. The plug 40 is now discharged below the plug assembly 22 and is no longer sealingly engaged with the seat 38. Flow is now permitted in both longitudinal directions through the plug assembly 22.

When used in the treatment system 10 and method of FIG. 1, multiple plug assemblies 22 can be set in the casing 18 to divide the wellbore 12 into corresponding multiple individual isolated sections. When a plug assembly 22 is set in the wellbore 12, and with the plug 40 sealingly engaged with the seat 38, a zone above the plug assembly can be treated by applying pressure to the wellbore above the plug assembly as described above.

When the predetermined opening pressure is applied to the wellbore 12 above the plug assembly 22, the plug 40 will be discharged from the seat 38, thus opening up flow though the plug assembly flow passage 34. In some examples, the plug 40 may displace downhole through the wellbore 12 to prevent flow through the next plug assembly 22, or it may lodge in the casing 18 somewhere to eventually be drilled out or to dissolve, or the plug 40 may be sized such that it can pass through the next lower plug assembly.

Figure 6:
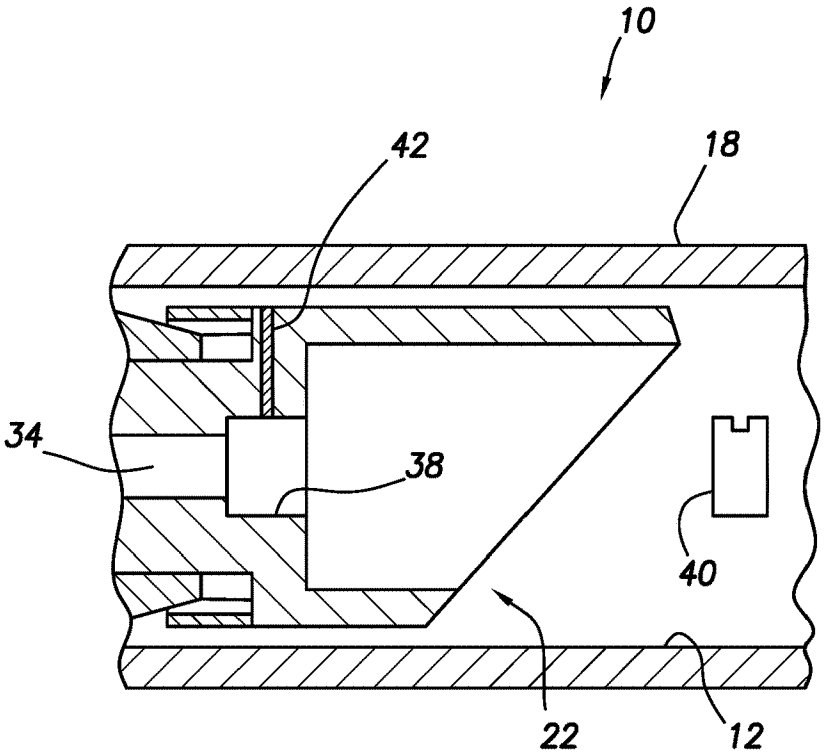
FIGS. 5 & 6 are representative cross-sectional views of another example of the plug assembly in plugged and unplugged configurations.
Figure 5:
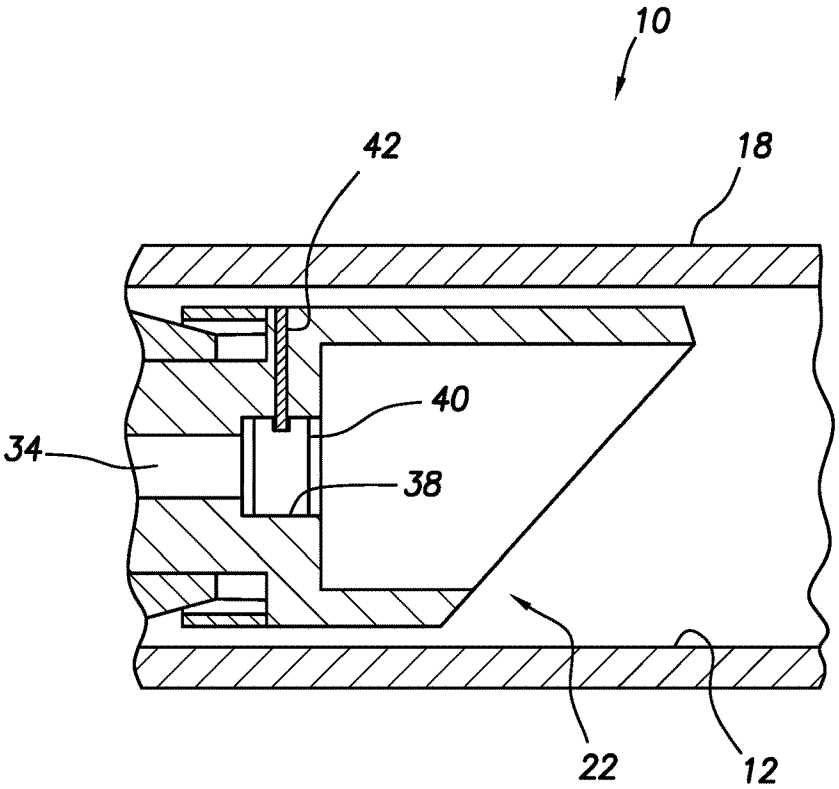

Referring additionally now to FIGS. 5 & 6, another example of the plug assembly 22 is representatively illustrated. In this example, the flow passage 34 is initially plugged with the plug 40 sealingly engaged with the seat 38. Flow is prevented in both directions through the flow passage 34.

The seat 38 in this example comprises a seal bore for sealingly receiving the plug 40. The plug 40 is cylindrical in shape (similar to a piston), and may be provided with seals for sealingly engaging the seat 38.

A shear member 42 (such as, a shear pin, shear screw, shear ring, etc.) releasably secures the plug 40 in sealing engagement with the seat 38. When the predetermined pressure differential is applied across the plug 40 and seat 38, the shear member 42 shears, thereby allowing the plug to be discharged from the seat and permitting communication through the flow passage 34 between the opposite sides of the plug assembly 22.

The plug 40 may either be captured and retained by the plug assembly 22 (e.g., in a receptacle attached to the plug assembly) or it may be discharged from the plug assembly and lie in the casing 18, until it is eventually drilled or it dissolves or otherwise degrades. The plug 40 may be shaped such that it can pass through the next lower plug assembly 22 (if the plug assembly is one of multiple plug assemblies 22*a-f*s in the well system 10 of FIG. 1).

In FIG. 5, the plug assembly 22 is set in the wellbore 12, so that it is sealingly and grippingly engaged with the casing 18. The plug 40 is sealingly engaged with the seat 38, thereby preventing flow through the flow passage 34 in both longitudinal directions.

In FIG. 6, the predetermined pressure differential has been applied across the plug 40 and seat 38. The shear member 42 has sheared, and the plug 40 has been discharged from the plug assembly 22. Flow is now permitted through the flow passage 34 in both longitudinal directions between opposite sides of the plug assembly 22.

In other examples, the plug assembly 22 may be provided with other devices that "open" in response to the predetermined pressure differential being applied. A frangible member (such as, a glass or ceramic disk, a rupture disk, or other barrier that extends across the flow passage 34) may initially block flow through the flow passage, and then be opened by breaking, piercing or rupturing the frangible member.

In the FIGS. 2-6 examples, or in any other examples in which the plug 40 is discharged from the plug assembly 22, it may also be desirable to shape an upper part of the plug assembly to prevent a plug 40 discharged from an upper plug assembly from entering or blocking the flow passage 34 through a lower plug assembly 22.

In another example, the plug assembly 22 may be "opened" by unsetting the plug assembly, so that fluid flow is permitted through the wellbore 12 at the location where the plug assembly was previously set. The plug assembly 22 in this example can be unset by retracting the slips 32 and seal element 28 in response to application of the predetermined pressure differential across the plug assembly.

Figure 7:
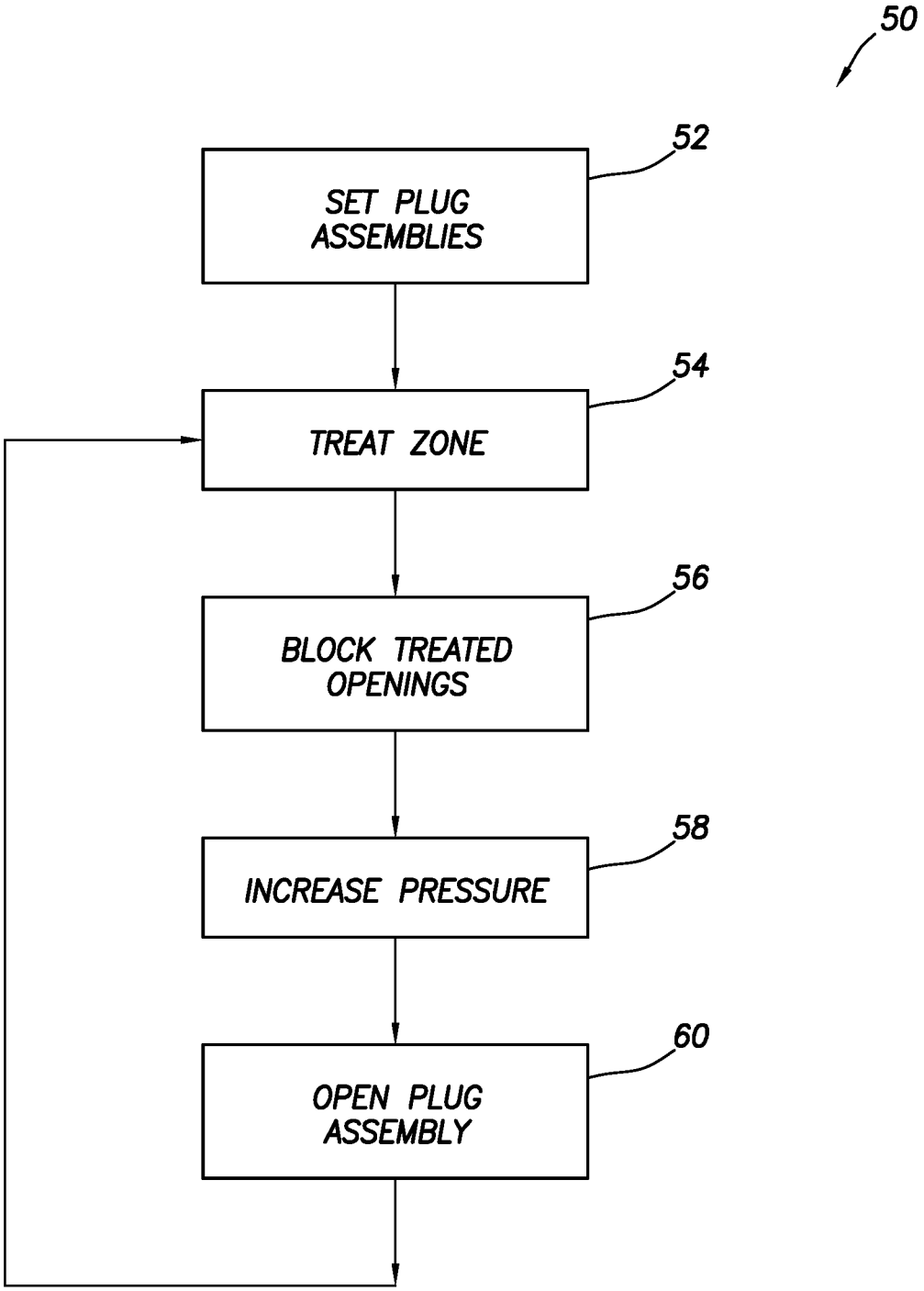
FIG. 7 is a representative flow chart for an example of a multiple zone well treatment method that can embody the principles of this disclosure.

Referring additionally now to FIG. 7, a flow chart for an example method 50 of treating a well is representatively illustrated. The method 50 is described below as it may be practiced with the well system 10 of FIG. 1 and any of the plug assembly 22 examples described herein, but it should be clearly understood that the method may be practiced with other well systems and plug assemblies in keeping with the scope of this disclosure.

In step 52, multiple plug assemblies 22*a-f* are set in the wellbore 12. The plug assemblies 22*a-f* in this example are set in the casing 18, so that they are positioned between the sets of openings 16*a-f* that provide fluid communication with the respective zones 14*a-f*.

In some examples, the plug assemblies 22*a-f* may be set in the wellbore 12 prior to the openings 16*a-f* being formed (such as, by perforating) or opened (such as, by shifting a sleeve of a casing valve). In other examples, the openings 16*a-f* may be formed or opened in a same trip into the wellbore 12 as setting the plug assemblies 22*a-f*.

Multiple plug assemblies 22*a-f* can be set in the wellbore 12 in a single trip into the wellbore 12. Alternatively, a single one of the plug assemblies 22*a-f* may be set in the wellbore 12 during each trip (with each trip optionally including a respective set of openings 16*a-f* being formed or opened).

In other examples, the wellbore 12 may be uncased or open hole where it penetrates the zones 14*a-f*. In such examples, the plug assemblies 22*a-f* may sealingly and grippingly engage an inner surface of the formation 14 surrounding the wellbore 12, and the openings 16*a-f* are not needed (i.e., the zones 14*a-f* are already in communication with the wellbore).

In step 54, an initial zone 14*f* is treated. Treatment fluid 24 can be flowed through the casing 18 or other tubular string, and into the zone 14*f*. The treatment fluid 24 can include a variety of different substances, and can vary (for example, in different pumped stages).

The treatment step 54 can be performed for a variety of different purposes. Treatment examples can include, but are not limited to, fracturing, acidizing, other types of stimulation, conformance, etc.

The plug assembly 22*f* in this step prevents the treatment fluid 24 from flowing to the next lower zone 14*e*, with the plug 40 preventing flow through the flow passage 34. Note that the plug 40 may prevent flow through the passage 34 of the plug assembly 22*f* when it is initially set in the wellbore 12 (as in the example of FIGS. 5 & 6), or the plug 40 may be installed in the plug assembly 22*f* after it is set in the wellbore, but before (or as) the treatment step 54 is performed (as in the example of FIGS. 2-4).

In step 56, flow through the openings 16*f* is blocked with the diverter 26 at a conclusion of the treatment step 54, thereby preventing further flow of the treatment fluid 24 into the zone 14*f*. The openings 16*f* may be blocked substantially simultaneously at the conclusion of the treatment step 54, or the openings may be blocked in stages, so that the openings that initially receive the most treatment fluid 24 are blocked first.

With all of the openings 16*f* blocked, continued pumping into the wellbore 12 will cause a further increase in pressure in the wellbore (greater than pressure in the wellbore during the treatment step 54). In step 58, the pressure is increased to a predetermined level, at which point the plug assembly 22*f* is opened (step 60) to thereby permit fluid flow through the plug assembly to the next lower zone 14*e*.

A variety of different techniques may be used to open the plug assembly 22*f* in response to the predetermined pressure being applied. The plug 40 may be discharged from the plug assembly 22*f* (as in the examples of FIGS. 2-6) in response to a predetermined pressure differential being applied across the plug. The plug 40 may be broken, fractured or burst in response to the predetermined pressure differential. The plug 40 may dissolve, disperse or otherwise degrade. The plug assembly 22*f* may be unset in response to the predetermined pressure being applied. Thus, the scope of this disclosure is not limited to any particular technique for opening the plug assemblies 22*a-f*.

If the plug 40 is discharged from the plug assembly 22*f* in step 60, the plug may be conveyed by flow and/or gravity to the next lower plug assembly 22*e*, in order to block flow through the passage 34 of the plug assembly 22*e*. For example, the plug 40 could be in the form of a compressible ball that can be forced through the seat 38 when the predetermined pressure differential is applied across the ball, so that the ball then is discharged from the plug assembly 22*f* and is received in the flow passage 34 of the next lower plug assembly 22*e*, where it sealingly engages the seat 38. In another example, the plug 40 could be substantially rigid, but the seat 38 could be expandable, so that the plug can be forced through the seat when the predetermined pressure differential is applied across the plug, so that the plug then is discharged from the plug assembly 22*f* and is received in the flow passage 34 of the next lower plug assembly 22*e*, where it sealingly engages the seat 38.

The steps 54-60 are repeated for each remaining zone 14*a-e* in succession. Note that, as each zone 14*a-f* is treated in step 54, the treatment fluid 24 flows only into that zone, due to any zones above being blocked with the diverter 26, and flow to zones below being prevented by the plug 40 of the respective one of the plug assemblies 22*a-f*. In this manner, flow velocity and fluid pressure in the wellbore 12 can be conveniently maintained as needed for optimum treatment of the zone and prevention of particulate accumulation in the wellbore.

After the last zone 14*a* has been treated, it is not necessary for the plug assembly 22*a* to be opened, if fluid communication with the wellbore 12 below the plug assembly is not required or desired. The plug assemblies 22*a-f* may be left in the wellbore 12 and remain during subsequent production or injection operations, or the plug assemblies may be unset and retrieved from the well, drilled or milled out, or allowed to dissolve or otherwise degrade in the well.

Figure 8:
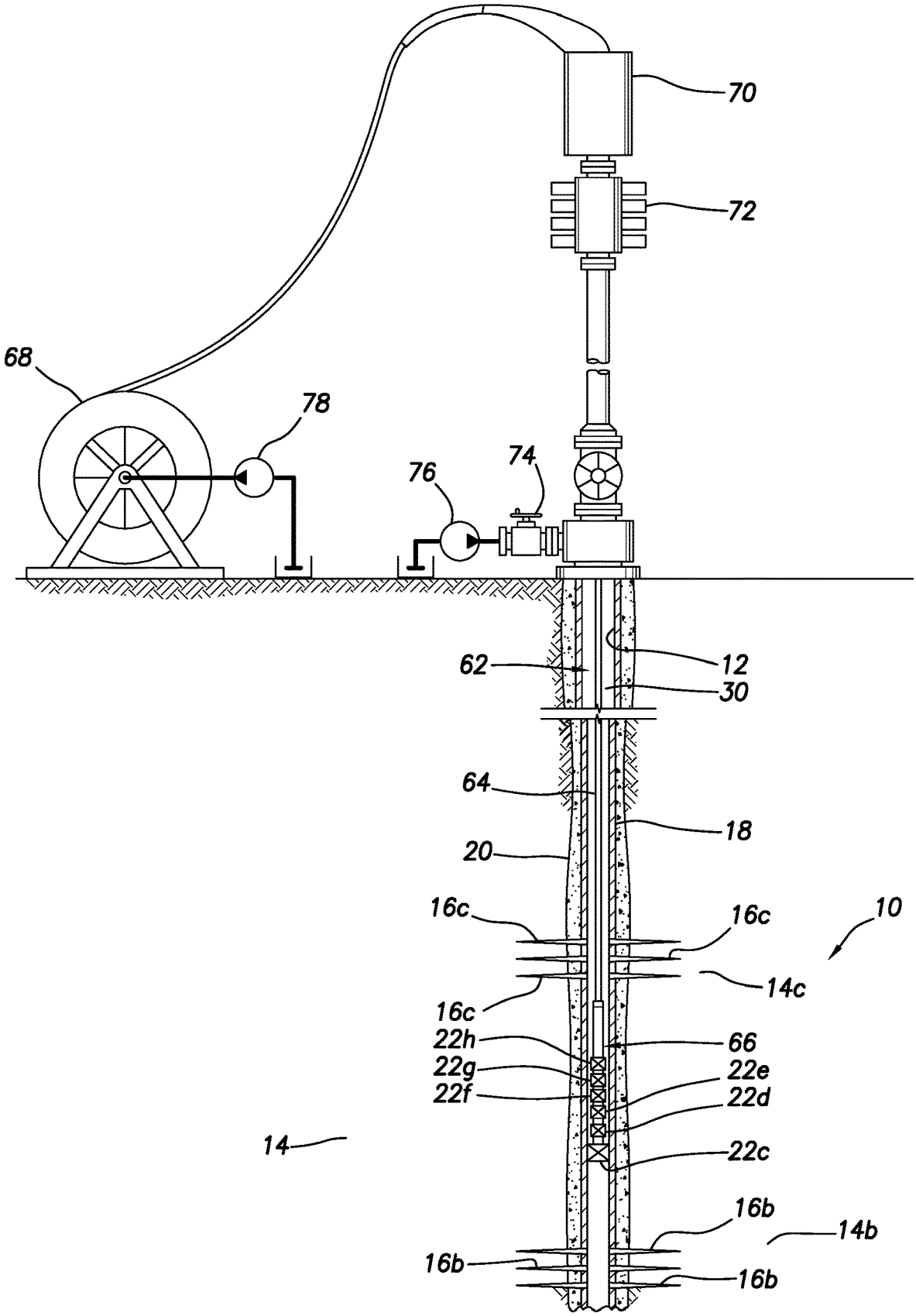
FIG. 8 is a representative partially cross-sectional view of another example of the well treatment system and method.

Referring additionally now to FIG. 8, another example of the well system 10 and method is representatively illustrated. In the FIG. 8 example, a tubular string 62 is conveyed into the wellbore 12 lined with the casing 18 and cement 20. Although multiple casing strings would typically be used in actual practice, for clarity of illustration only one casing string 18 is depicted in the drawings.

Although the wellbore 12 is illustrated as being vertical, sections of the wellbore could instead be horizontal or otherwise inclined relative to vertical. Although the wellbore 12 is completely cased and cemented as depicted in FIG. 8, any sections of the wellbore in which operations described in more detail below are performed could be uncased or open hole. Thus, the scope of this disclosure is not limited to any particular details of the FIG. 8 system 10 and method.

The tubular string 62 of FIG. 1 comprises coiled tubing 64 and a bottom hole assembly 66. As used herein, the term "coiled tubing" refers to a substantially continuous tubing that is stored on a spool or reel 68. The reel 68 could be mounted, for example, on a skid, a trailer, a floating vessel, a vehicle, etc., for transport to a wellsite. Although not shown in FIG. 8, a control room or cab would typically be provided with instrumentation, computers, controllers, recorders, etc., for controlling equipment such as an injector 70 and a blowout preventer stack 72.

As used herein, the term "bottom hole assembly" refers to an assembly connected at a distal end of a tubular string or other conveyance in a well. It is not necessary for a bottom hole assembly to be positioned or used at a "bottom" of a hole or well.

When the tubular string 62 is positioned in the wellbore 12, the annulus 30 is formed radially between them. Fluid, slurries, etc., can be flowed from surface into the annulus 30 via, for example, a casing valve 74. One or more pumps 76 may be used for this purpose. Fluid can also be flowed to surface from the wellbore 12 via the annulus 30 and valve 74.

Fluid, slurries, etc., can also be flowed from surface into the wellbore 12 via the tubing 64, for example, using one or more pumps 78. Fluid can also be flowed to surface from the wellbore 12 via the tubing 64. Thus, in the treatment and blocking steps 54, 56 of the FIG. 7 method 50, the treatment fluid 24 and/or diverter 26 could be flowed into the wellbore 12 via the annulus 30 or the tubular string 62.

In the FIG. 8 example, the bottom hole assembly 66 includes multiple plug assemblies 22*a-h*, although only the plug assemblies 22*c-h* are visible (the plug assemblies 22*a,b* having been previously set in the wellbore 12). The plug assemblies 22*a-h* are set in the wellbore 12, with each plug assembly being set between an adjacent pair of the openings 16*a-f* that provide fluid communication between the wellbore 12 and the formation 14.

It is not necessary for the number of plug assemblies 22*a-h* conveyed simultaneously into the wellbore 12 in a single trip to equal the number of zones 14*a-f* to be treated. In the FIG. 8 example, the number of plug assemblies 22*a-h* in the bottom hole assembly 66 could be greater than the number of zones 14*a-f* to be treated, so that spare or additional plug assemblies 22*g,h* are available, in case one or more of the plug assemblies should fail to set or otherwise malfunction.

The plug assemblies 22*a-h* may be selectively set in response to pressure levels, manipulations, pulses or signals transmitted via the tubing 64 and/or annulus 30. Alternatively, the plug assemblies 22*a-h* may be selectively set in response to electrical signals transmitted via conductors (not shown) in the tubing 64, or via the tubing itself. Mechanical manipulation of the tubular string 62 or any component thereof may alternatively be used to selectively set the plug assemblies 22*a-h*. Thus, the scope of this disclosure is not limited to any particular technique for setting the plug assemblies 22*a-h*.

In other examples, the bottom hole assembly 66 could be conveyed by wireline, slickline, jointed tubing, downhole tractor, remote operated vehicle or another type of conveyance. Thus, the scope of this disclosure is not limited to any particular technique for conveying the bottom hole assembly 66 or any of the plug assemblies 22*a-h* in the well.

Figure 9:
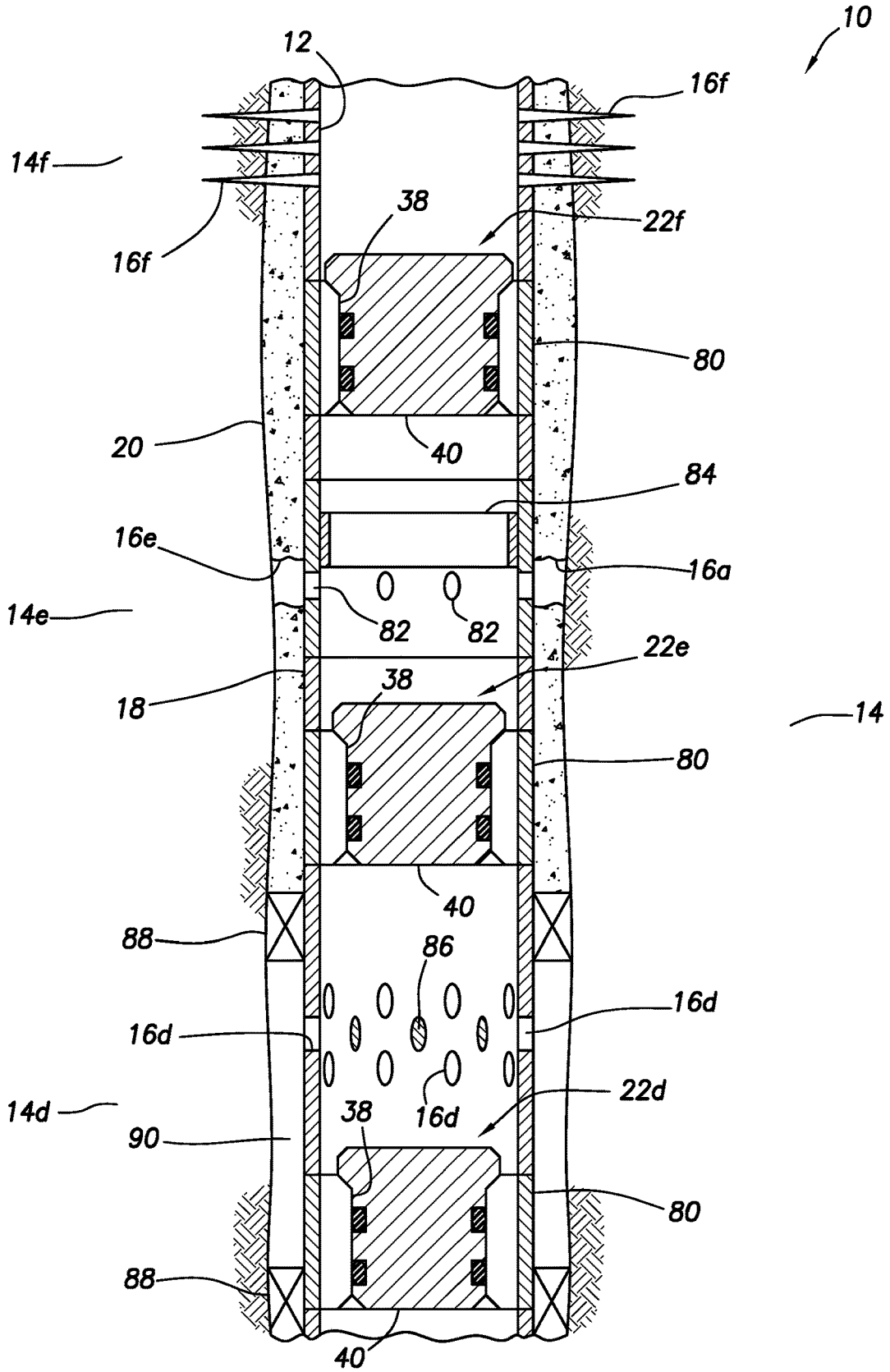
FIG. 9 is a representative cross-sectional view of a further example of the well treatment system and method.

Referring additionally now to FIG. 9, another example of the treatment system 10 and method is representatively illustrated. In this example, the plug assemblies 22*d-f* are differently configured, and a variety of different techniques for forming the openings 16*d-f* are used. Any or all of these techniques may be used for any of the openings 16*a-f* in the FIG. 1 treatment system 10 and method.

The plug assemblies 22*d-f* depicted in FIG. 9 do not include the seal element 28 and slips 32 of FIG. 2. Instead, the seats 38 are formed in sections 80 of the casing 18. The plugs 40 sealingly engage the seats 38, before, after or during installation of the casing 18 in the well.

The seats 38 may be expandable, or the plugs 40 may be compressible, in order to open the plug assemblies 22*d-f* in response to pressure applied in the wellbore 12, for example, as described above. In the FIG. 9 example, the uppermost seat 38 and plug 40 (in the plug assembly 22*f*) are larger in diameter than the next lower seat and plug (in the plug assembly 22*e*) which are, in turn, larger in diameter than the next lower seat and plug (in the plug assembly 22*d*). In this manner, each plug 40 is prevented from passing through the next lower plug assembly. The plug 40 may be captured in a screen or other receptacle below its corresponding plug assembly, so that the plug does not block flow through the next lower plug assembly.

In other examples, the uppermost seat 38 and plug 40 (in the plug assembly 22*f*) may be smaller in diameter than the next lower seat and plug (in the plug assembly 22*e*) which, in turn, may be smaller in diameter than the next lower seat and plug (in the plug assembly 22*d*). In this manner, each plug 40 can pass through the next lower plug assembly, so that all of the plugs will eventually accumulate in the wellbore 12 below the lowermost plug assembly. The plugs 40 may be left in the wellbore 12, they may subsequently be drilled, or they may disperse, dissolve or otherwise degrade due to passage of time, exposure to elevated temperature or exposure to a particular fluid (such as, acid).

The openings 16*f* in the FIG. 9 example are perforations formed through the casing 18 and cement 20. The perforations may be formed before or after the plug assemblies 22*d-f*, or any of them) are set in the wellbore 12.

The openings 16*e* are partially formed through the cement 20, and partially formed as ports 82 that can be opened or closed with a sliding sleeve 84. The openings 16*e* through the cement 20 may be formed by retarding hardening of the cement or leaving a void in the cement external to the ports 82. The well tools, retarder chemicals and techniques described in U.S. Pat. No. 9,309,746 may be used for this purpose.

The openings 16*d* are initially formed through the casing section 80, but are blocked with a degradable substance 86, prior to installing the casing 18. Thus, when the casing 18 is installed in the well, flow through the openings 16*d* is prevented.

After installation in the well, the substance 86 degrades, thereby permitting flow through the openings 16*d*. The substance 86 may degrade prior to, or after, the plugs 40 are installed in the seats 38.

The substance 86 may melt, corrode, dissolve, or otherwise degrade or disperse in the well. Degradation of the substance 86 may occur in response to passage of a certain period of time, exposure to elevated temperature, exposure to a particular fluid in the well, or in response to any other stimulus or condition. For example, the substance 86 could comprise a wax, poly-lactic acid (PLA), poly-glycolic acid (PGA), an anhydrous boron compound, eutectic metal, magnesium, aluminum, etc.

Note that there is no cement 20 surrounding the section of casing 18 having the openings 16*d* therein. Instead, external casing packers (ECP's) 88 isolate the zone 14*d* from the other formation zones in an annulus 90 formed radially between the casing 18 and the inner surface of the formation 14.

As mentioned above in relation to the FIG. 1 example, plugging devices (such as, the plugging devices described in U.S. Pat. No. 9,567,826) may be used to block flow through the openings 16*a-f* after each treatment step 54. Thus, the plugging devices can comprise the diverter 26. In addition, or alternatively, the plugging devices can be introduced into the casing 18 as it is being installed in the well, so that the openings 16*a-f* are initially blocked by the plugging devices.

After installation of the casing 18 (and any cement 20), the plugging devices can disperse, dissolve or otherwise degrade to thereby permit flow through the openings 16*a-f*. The plugging devices can degrade in the well before or after the plug assemblies 22*a-f* are set in the wellbore 12, or the plugs 40 are engaged with the seats 38.

In some example methods and apparatus for completing a well, pre-perforated sections of casing 18 (e.g., having openings 16*d* therein) are run in the well such that once the entire casing string is placed in the well, the perforations or openings 16*d* are located where desired relative to the formation 14 (such as, adjacent the respective zones 14*a-f*).

At the time the casing 18 is being run into the well, the openings 16*d* are plugged with a self-degrading material or substance 86 (such as, magnesium, PLA, PGA, etc.) which blocks flow through the openings. During running and cementing operations, the perforated casing 18 sections function like non-perforated casing sections (such as, preventing flow between an interior and an exterior of the casing 18 through its wall).

After a period of time (or in response to a selected stimulus), the plugging material or substance 86 degrades, leaving open perforations (e.g., openings 16*d*) in the casing 18. The well can then be completed using the methods described above. In other examples, the plugging material or substance 86 may be milled out, chemically removed, or may disappear, dissolve or degrade due to a combination of time, chemicals application, heat, etc.

It may now be fully appreciated that the above disclosure provides significant advancements to the art of constructing and utilizing well treatment systems. In an example described above, multiple zones 14*a-f* can be treated by repeating the steps of flowing a treatment fluid (step 54), blocking treated openings 16*a-f* (step 56), increasing pressure in the wellbore 12 due to the blocking (step 58), and opening the plug assemblies 22*a-f* in response to the increased pressure.

The above disclosure provides to the art a method 50 of treating each of multiple formation zones 14*a-f* in a subterranean well. In one example, the method 50 can comprise: isolating first and second zones 14*f,e* from each other in a wellbore 12 with a first plug assembly 22*f* positioned in the wellbore 12; treating the first zone 14*f* by flowing a treatment fluid 24 through first openings 16*f* that provide fluid communication between the wellbore 12 and the first zone 14*f*; then blocking flow through the first openings 16*f*; increasing pressure in the wellbore 12 in response to the blocking; and opening the first plug assembly 22*f* in response to the pressure increasing.

The treating step may include fracturing the first zone 14*f*. The blocking step may include displacing a diverter 26 through the wellbore 12 to the first openings 16*f*.

The opening step may include discharging a plug 40 from the first plug assembly 22*f*, thereby permitting flow through the first plug assembly 22*f*. The method may include the plug 40 degrading in the well.

The method may include sealingly engaging the plug 40 with the second plug assembly 22*e*, thereby preventing fluid flow through the second plug assembly 22*e*. The method may include discharging the plug 40 from the second plug assembly 22*e*, thereby permitting flow through the second plug assembly 22*e*. The method may include treating the second zone 14*e* after the plug 40 sealingly engages the second plug assembly 22*e*, and before the plug 40 is discharged from the second plug assembly 22*e*.

The method may include: treating the second zone 14*e* by flowing treatment fluid 24 through second openings 16*e* that provide fluid communication between the wellbore 12 and the second zone 14*e*; then blocking flow through the second openings 16*e*; increasing pressure in the wellbore 12 in response to the blocking of flow through the second openings 16*e*; and opening the second plug assembly 22*e* in response to the pressure increasing in the wellbore 12 in response to the blocking of flow through the second openings 16*e*.

The method may include conveying the first plug assembly 22*f* and a second plug assembly 22*e* into the wellbore 12 in a single trip into the wellbore 12.

The method may include installing a plug 40 in the first plug assembly 22*f*, thereby preventing flow through the first plug assembly 22*f*, prior to or after installing the first plug assembly 22*f* in the well.

The isolating step may include setting the first plug assembly 22*f* in the wellbore 12, so that the first plug assembly 22*f* sealingly and grippingly engages the wellbore 12.

The first plug assembly 22*f* may comprise a seat 38 formed in a casing section 80. The isolating step may include sealingly engaging a plug 40 with the seat 38.

The opening step may include unsetting the first plug assembly 22*f*.

The above disclosure also provides to the art a well treatment system 10 for treating each of multiple zones 14*a-f* intersected by a wellbore 12. In one example, the well treatment system 10 can comprise multiple plug assemblies 22*a-f* in the wellbore 12, each of the plug assemblies 22*a-f* isolating a respective adjacent pair of the zones 14*a-f* from each other in the wellbore 12. Each of the plug assemblies 22*a-f* opens in response to a respective predetermined pressure differential applied across the plug assembly 22*a-f*.

Each of the plug assemblies 22*a-f* may comprise a plug 40 that prevents fluid flow through a flow passage 34 extending longitudinally through the plug assembly 22*a-f*. The plug 40 may permit fluid flow in response to the predetermined pressure differential.

The plug 40 may be discharged from the corresponding plug assembly 22*a-f* in response to the predetermined pressure differential. The plug 40 may degrade in the well.

Each of the plug assemblies 22*a-f* may comprise a seat 38 formed in a casing section 80.

A diverter 26 may block flow through openings 16*a-f* that provide fluid communication between the wellbore 12 and the zones 14*a-f*. The diverter 26 may degrade in the well.

Another method 50 of treating each of multiple formation zones 14*a-f* in a subterranean well can include installing multiple plug assemblies 22*a-f* in a wellbore 12, each of the plug assemblies 22*a-f* being positioned between adjacent sets of openings 16*a-f*, each of the sets of openings 16*a-f* providing fluid communication between the wellbore 12 and a respective one of the zones 14*a-f*; and repeating the following steps a) to d) for each of the zones 14*a-f* in succession: a) treating the zone 14*a-f* by flowing a treatment fluid 24 through a corresponding set of the openings 16*a-f*, b) blocking flow through the corresponding set of the openings 16*a-f*, c) increasing pressure in the wellbore 12, and d) in response to the pressure increasing, opening the plug assembly 22*a-f* that isolated the zone 14*a-f* from a next zone in succession.

The blocking step may include displacing a diverter 26 through the wellbore 12 to the corresponding set of the openings 16*a-f*. The treating step may include fracturing the zone 14*a-f*.

The opening step may include discharging a plug 40 from the plug assembly 22*a-f* that isolated the zone 14*a-f* from the next zone in succession, thereby permitting flow between the zone 14*a-f* and the next zone in succession. The method may include the plug 40 degrading in the well.

The method may include sealingly engaging the plug 40 with the plug assembly 22*a-f* that isolated the zone 14*a-f* from the next zone in succession. The method may include discharging the plug 40 from the plug assembly 22*a-f* that isolated the zone 14*a-f* from the next zone in succession.

The method may include treating the next zone 22*a-f* in succession after the plug 40 sealingly engages the plug assembly 22*a-f* that isolated the zone 14*a-f* from the next zone in succession, and before the plug 40 is discharged from the plug assembly 22*a-f* that isolated the zone 14*a-f* from the next zone in succession.

The method may include conveying the multiple plug assemblies 22*a-f* into the wellbore 12 in a single trip into the wellbore 12.

The method may include installing a plug 40 in each of the plug assemblies 22*a-f*, thereby preventing flow through the plug assemblies 22*a-f*, prior to or after installing the plug assemblies 22*a-f* in the well.

The installing step may include setting the plug assemblies 22*a-f* in the wellbore 12, so that the plug assemblies 22*a-f* sealingly and grippingly engage the wellbore 12.

Each of the plug assemblies 22*a-f* may comprise a seat 38 formed in a casing section 80. The method may include sealingly engaging a plug 40 with each of the seats 38.

The opening step may include unsetting the plug assembly 22*a-f* that isolated the zone 14*a-f* from the next zone in succession.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of treating each of multiple formation zones in a subterranean well, the method comprising:

preventing longitudinal fluid flow through a wellbore with a first plug assembly, thereby isolating first and second formation zones from each other;

treating the first formation zone by flowing a treatment fluid through first openings that provide fluid communication between the wellbore and the first formation zone;

then blocking flow through the first openings;

then increasing pressure in the wellbore uphole of the first plug assembly while the first openings remain blocked; and then opening the first plug assembly in response to the pressure increasing, while the first openings remain blocked.

2. The method of claim 1, in which the blocking comprises displacing a diverter through the wellbore to the first openings.

3. The method of claim 1, in which the treating comprises fracturing the first formation zone.

4. The method of claim 1, in which the opening comprises discharging a plug from the first plug assembly, thereby permitting the longitudinal fluid flow through the first plug assembly.

5. The method of claim 4, further comprising the plug degrading in the well.

6. The method of claim 4, further comprising sealingly engaging the plug with a second plug assembly, thereby preventing fluid flow through the second plug assembly.

7. The method of claim 6, further comprising discharging the plug from the second plug assembly, thereby permitting flow through the second plug assembly.

8. The method of claim 7, further comprising treating the second formation zone after the plug sealingly engages the second plug assembly, and before the plug is discharged from the second plug assembly.

9. The method of claim 1, further comprising:

treating the second formation zone by flowing treatment fluid through second openings that provide fluid communication between the wellbore and the second formation zone;

then blocking flow through the second openings;

increasing pressure in the wellbore in response to the blocking of flow through the second openings; and opening a second plug assembly in response to the pressure increasing in the wellbore in response to the blocking of flow through the second openings.

10. The method of claim 1, further comprising conveying the first plug assembly and a second plug assembly into the wellbore in a single trip into the wellbore.

11. The method of claim 1, further comprising installing a plug in the first plug assembly, thereby preventing flow through the first plug assembly, prior to installing the first plug assembly in the well.

12. The method of claim 1, further comprising installing a plug in the first plug assembly, thereby preventing flow through the first plug assembly, after installing the first plug assembly in the well.

13. The method of claim 1, in which the isolating comprises setting the first plug assembly in the wellbore, so that the first plug assembly sealingly and grippingly engages the wellbore.

14. The method of claim 1, in which the first plug assembly comprises a seat formed in a casing section.

15. The method of claim 14, in which the isolating comprises sealingly engaging a plug with the seat.

16. The method of claim 1, in which the opening comprises unsetting the first plug assembly.

17. A well treatment system for treating each of multiple formation zones intersected by a wellbore, the well treatment system comprising:

multiple plug assemblies in the wellbore, each of the plug assemblies isolating a respective adjacent pair of the formation zones from each other in the wellbore, and each of the plug assemblies comprising a flow passage extending longitudinally therethrough, in which the flow passage of a respective plug assembly opens in response to a respective predetermined pressure differential applied across the respective plug assembly via an increase in pressure above the respective plug assembly, and in which the multiple formation zones are successively treated beginning with a formation zone closest to a surface of the earth along the wellbore.

18. The system of claim 17, in which each plug assembly comprises a plug that prevents fluid flow through the flow passage.

19. The system of claim 18, in which the plug permits fluid flow in response to the predetermined pressure differential.

20. The system of claim 18, in which the plug is discharged from the respective plug assembly in response to the predetermined pressure differential.

21. The system of claim 18, in which the plug degrades in the well.

22. The system of claim 17, in which each plug assembly comprises a seat formed in a casing section.

23. The system of claim 17, in which a diverter blocks flow through openings that provide fluid communication between the wellbore and the formation zones.

24. The system of claim 23, in which the diverter degrades in the well.

25. A method of treating each of multiple formation zones in a subterranean well, the method comprising:

installing multiple plug assemblies in a wellbore, each of the plug assemblies being positioned between adjacent sets of openings, each of the sets of openings providing fluid communication between the wellbore and a respective one of the formation zones; and repeating the following steps a) to d) for each of the formation zones in succession:

a) treating the formation zone by flowing a treatment fluid through a corresponding set of the openings, b) then blocking flow through the corresponding set of the openings, c) then, while the flow through the corresponding set of the openings remains blocked, increasing pressure in the wellbore uphole of the plug assembly that isolated the formation zone from a next formation zone in succession, and d) then, while the flow through the corresponding set of the openings remains blocked, and in response to the pressure increasing, opening the plug assembly that isolated the formation zone from the next formation zone in succession.

26. The method of claim 25, in which the blocking comprises displacing a diverter through the wellbore to the corresponding set of the openings.

27. The method of claim 25, in which the treating comprises fracturing the formation zone.

28. The method of claim 25, in which the opening comprises discharging a plug from the plug assembly that isolated the formation zone from the next formation zone in succession, thereby permitting flow between the formation zone and the next formation zone in succession.

29. The method of claim 28, further comprising the plug degrading in the well.

30. The method of claim 28, further comprising sealingly engaging the plug with the plug assembly that isolated the formation zone from the next formation zone in succession.

31. The method of claim 30, further comprising discharging the plug from the plug assembly that isolated the formation zone from the next formation zone in succession.

32. The method of claim 25, further comprising conveying the multiple plug assemblies into the wellbore in a single trip into the wellbore.

33. The method of claim 25, further comprising installing a respective plug in each of the plug assemblies, thereby preventing flow through the plug assemblies, prior to installing the plug assemblies in the well.

34. The method of claim 25, further comprising installing a respective plug in each of the plug assemblies, thereby preventing flow through the plug assemblies, after installing the plug assemblies in the well.

35. The method of claim 25, in which the installing comprises setting the plug assemblies in the wellbore, so that the plug assemblies sealingly and grippingly engage the wellbore.

36. The method of claim 25, in which each of the plug assemblies comprises a seat formed in a casing section.

37. The method of claim 6, further comprising sealingly engaging a plug with each of the seats.

38. The method of claim 25, in which the opening comprises unsetting the plug assembly that isolated the formation zone from the next formation zone in succession.

39. The method of claim 31, further comprising treating the next formation zone in succession after the plug sealingly engages the plug assembly that isolated the formation zone from the next formation zone in succession, and before the plug is discharged from the plug assembly that isolated the formation zone from the next formation zone in succession.

* * * * *